US005236613A

United States Patent [19]

Garner-Gray et al.

[11] Patent Number: 5,236,613

[45] Date of Patent: Aug. 17, 1993

[54] PARTICULATE BLEACHING DETERGENT COMPOSITION

[75] Inventors: Peter F. Garner-Gray, Fulwood; Ian E. Niven, Liverpool, both of Great Britain

[73] Assignee: Lever Brothers Company, Division of Conopco, Inc., New York, N.Y.

[21] Appl. No.: 682,038

[22] Filed: Apr. 8, 1991

[30] Foreign Application Priority Data

Apr. 9, 1990 [GB] United Kingdom ..... 9007999

[51] Int. Cl.[5] ..... C11D 3/395

[52] U.S. Cl. ..... 252/94; 252/95; 252/99; 252/174.25; 423/415.2

[58] Field of Search ..... 252/95, 99, 174.25, 252/94; 423/415 P

[56] References Cited

U.S. PATENT DOCUMENTS

| | | | |
|---|---|---|---|
| 3,789,001 | 1/1974 | Painelli | 252/99 |
| 4,055,505 | 10/1977 | Gray | 252/99 |
| 4,146,571 | 3/1979 | Will et al. | 423/415 P |
| 4,416,606 | 11/1983 | Sugano et al. | 425/202 |
| 4,526,698 | 7/1985 | Kuroda et al. | 252/99 |

FOREIGN PATENT DOCUMENTS

| | | |
|---|---|---|
| 056723 | 1/1982 | European Pat. Off. . |
| 339996 | 4/1989 | European Pat. Off. . |
| 8504521 | 6/1986 | Sweden . |
| 461392 | 2/1990 | Sweden . |
| 1451719 | 10/1976 | United Kingdom . |
| 2013259 | 8/1979 | United Kingdom . |
| 2019825 | 11/1979 | United Kingdom . |

*Primary Examiner*—Olik Chaudhuri
*Assistant Examiner*—C. Everhart
*Attorney, Agent, or Firm*—Milton L. Honig

[57] ABSTRACT

There is provided a particulate bleaching detergent composition having improved stability, said composition comprising a zeolite built base powder and alkali-metal percarbonate particles having a morphology index of less than 0.06. The morphology index is defined as:

$$MI = 0.0448 * CV + 3.61 * 10^6/d^3$$

where CV is the coefficient of variation of the weight average particle size distribution, and d is the weight mean average particle size (in microns).

16 Claims, No Drawings

PARTICULATE BLEACHING DETERGENT COMPOSITION

TECHNICAL FIELD

The present invention relates to a particulate bleaching detergent composition. More particularly, it relates to detergent powders which contain sodium percarbonate as bleaching agent Furthermore, it relates to a process for preparing such powders.

BACKGROUND AND PRIOR ART

In recent years the use of sodium perborate as bleaching agent in bleaching detergent compositions has become widespread. It has a number of advantages, especially in combination with bleach activators such as tetra acetyl ethylene diamine (TAED), which enables effective bleaching at lower temperatures down to 40° C. The function of the perborate in this bleach system is to provide a stable source of hydrogen peroxide. A number of other inorganic peroxides which are capable of liberating hydrogen peroxide have also been considered. An example of such a compound is sodium percarbonate, having the formula $2Na_2CO_3.3H_2O_2$ Unfortunately, when conventional sodium percarbonate is admixed to a detergent base powder, it is rapidly decomposed at temperatures of above 30° C. and under humid atmospheric conditions. Thus the use of the sodium percarbonate as a bleaching agent in detergent powders has up to now been severely restricted by its limited storage stability.

Various attempts have been made to improve the stability of sodium percarbonate in detergent formulations. For instance, it has been proposed in GB-A-2 019 825 (Kao) to coat the percarbonate particles by spraying a solution containing an alkaline earth metal salt onto the particles.

GB-A-1 451 719 (Kao) discloses that the stability of a percarbonate containing phosphate built detergent composition can be improved when at least 60% by weight of the base powder and of the percarbonate has a particle diameter larger than 250 μm, provided that the copper content of the base powder is less than 2 ppm and the iron content is less than 5 ppm.

The storage stability of sodium percarbonate in zeolite built detergent powders constitutes an even greater problem, possibly because of their large mobile water contents.

GB-A-2 013 259 discloses that the stability of sodium percarbonate in a zeolite built formulation may be improved if special requirements are met with regard to the zeolite, which must be either less than 75% crystalline or else may be of any crystallinity and have 1 to 10% of its sodium ions replaced by calcium and/or magnesium.

We have now found that the stability of a zeolite built detergent powder which contains sodium percarbonate as bleaching agent may be substantially improved by controlling the morphology of the percarbonate.

DEFINITION OF THE INVENTION

According to a first aspect, the invention provides a particulate bleaching detergent composition comprising a zeolite built base powder and alkalimetal percarbonate particles having a morphology index (as defined hereafter) of less than 0.06. Preferably, the morphology index is less than 0.04, less than 0.03 being especially preferred. The alkalimetal percarbonate is preferably sodium percarbonate, preferably in an uncoated form.

It is furthermore preferred that the composition is substantially free from inorganic phosphate.

A further aspect of the invention is an alkalimetal percarbonate material consisting of particles having a morphology index (as defined hereafter) of less than 0.06.

DETAILED DESCRIPTION OF THE INVENTION

The first aspect of the invention is a bleaching detergent powder which may be prepared at least in part by spray-drying. The composition of the invention comprises a zeolite built base powder which may be suitably prepared by spray-drying, to which alkalimetal percarbonate bleaching particles of a distinct morphology are admixed to form a finished product.

As essential ingredients, the detergent base powder of the invention contains a zeolite builder material and one or more anionic and/or nonionic surfactants.

The composition of the invention may also contain any of the materials conventionally included in detergent compositions. These are described in more detail below.

The Detergent Base Powder

The detergent base powder according to the invention is a low- or zero-phosphate powder containing crystalline aluminosilicate (zeolite) or amorphous aluminosilicate. The aluminosilicate may suitably be present in an amount of from 10 to 80% by weight. Other, supplementary, builders may also be present, for example, polycarboxylate polymers such as polyacrylates, acrylic-maleic copolymers, or acrylic phosphinates; monomeric polycarboxylates such as nitrilotriacetates and ethylene diamine tetraacetates; inorganic salts such as sodium carbonate; sodium citrate/citric acid; and many other materials familiar to the skilled detergent formulator.

The total amount of surfactant present in the composition of the invention will generally range from 5 to 40% by weight, more preferably from 10 to 30% by weight and especially from 12 to 20% by weight. These figures are typical for fully formulated detergent compositions, and where a spray-dried base forms only part of such a composition the surfactant content of that base, as a percentage, may of course be higher.

The invention is of especial applicability to compositions containing anionic surfactant. The amount of anionic surfactant present is desirably at least 5% by weight, and may suitably be in the range of from 5 to 30% by weight, preferably from 5 to 10% by weight, these figures again being based on a fully formulated detergent composition.

Anionic surfactants are well known to those skilled in the art. Examples include alkylbenzene sulphonates, particularly sodium linear alkylbenzene sulphonates having an alkyl chain length of $C_8$–$C_{15}$; primary and secondary alkyl sulphates, particularly sodium $C_{12}$–$C_{15}$ primary alcohol sulphates; olefin sulphonates; alkane sulphonates; dialkyl sulphosuccinates; and fatty acid ester sulphonates.

Preferably, the composition of the invention also contains one or more nonionic surfactants. Nonionic surfactants that may be used include the primary and secondary alcohol ethoxylates, especially the $C_{12}$–$C_{15}$ primary and secondary alcohols ethoxylated with an average of from 3 to 20 moles of ethylene oxide per mole of alcohol.

The weight ratio of anionic surfactant to nonionic surfactant is preferably at least 0.67:1, more preferably at least 1:1, and most preferably within the range of from 1:1 to 10:1, in order to obtain the optimum detergency and foaming properties appropriate for front-loading automatic washing machines These ratios of course apply to fully formulated products. A spray-dried base that is to form only part of a product may contain a lower proportion of, or no nonionic surfactant, the balance of the nonionic surfactant being added after the spray-drying tower.

If desired, the powder of the invention may contain sodium silicate. High levels of silicate can in themselves have a beneficial effect on dispensing, as well as on powder structure and prevention of machine corrosion, but are undesirable in powders containing aluminosilicate because the two components react together to form insoluble siliceous species. Accordingly, the invention is of especial applicability to powders containing less that 10% by weight, more especially less than 5% by weight, of sodium silicate.

The Percarbonate Bleaching Material

The characterizing feature of the compositions of the present invention is the presence of an alkalimetal percarbonate bleaching material, preferably sodium percarbonate, having a controlled morphology.

The combined relevant aspects of the percarbonate morphology can be readily described by means of a morphology index (MI), which is determined by the weight average mean particle size and the coefficient of its distribution.

For the purpose of the invention, the morphology index is defined as:

$$MI=0.0448 * CV+3.61 * 10^6/d^3$$

where "CV" is the coefficient of variation of the weight average particle size distribution, and "d" is the weight mean average particle size (in microns), as defined by the following equations.

$$CV=\sigma/d$$

wherein $$\sigma^2\Sigma(d_i-d)^2*w_i/100$$

and $$d=\Sigma d_i*w_i/100$$

where $d_i$ is the average particle size of the i'th size fraction of the complete distribution, and $w_i$ is the weight percentage of that fraction.

It was found that the stability of the percarbonate increases with decreasing values of the morphology index. Acceptable stability occurs for values of the morphology index of less than 0.06 while superior stabilities can be achieved for lower values of the morphology index. The value of MI according to the invention should therefore be less than 0.06, preferably less than 0.04, and more preferably less than 0.03.

It is thus essential that the percarbonate material has a well defined morphology. In particular, that its weight average mean particle size and coefficient of variation are sufficient to give a morphology index as defined above of less than 0.06. When this condition is fulfilled, there is no need to resort to other, more complicated methods of improving the stability of the percarbonate, such as coating the percarbonate.

The percarbonate material is preferably present in an amount of from 5 to 25% by weight. More preferably it is present in the range 8 to 20% by weight, based on the full product formulation.

The composition of the invention may be prepared by a process which comprises the step of spray-drying an aqueous crutcher slurry to form a base powder. This slurry will normally contain all those desired ingredients sufficiently heat-stable to survive the spray-drying process, notably anionic surfactants, builders, inorganic salts, sodium silicate, polymers and fluorescers. More heat-sensitive ingredients can be postdosed to, or sprayed onto, the spray-dried base powder.

The percarbonate material having a controlled morphology is then postdosed to the base powder to form a bleaching detergent formulation. Other solid materials, e.g. bleach activator granules, enzyme granules, anti-foam granules, may also be postdosed.

The percarbonate having the desired morphology index of less than 0.06 may be prepared from a sample of percarbonate material having an unknown morphology index by preparing various sieve fractions of that material according to conventional methods, preferably having 5 ranges of about 100 microns or less. Subsequently, the morphology index of each fraction is calculated by means of the formulas given on page 5.

It is surprising that addition of sodium percarbonate of the specified morphology to such a zeolite built base powder provides a good storage stability of the bleaching material, in spite of the relatively high content of such base powders in iron and copper. For instance, a typical zeolite material such as Wessalith P ex Degussa may contain up to 300 ppm iron.

The Percarbonate Stability

It is an essential feature of the bleaching detergent composition of the invention that the incorporation of a percarbonate material such as sodium percarbonate—as specified above—should bring about an improvement in the stability of the bleaching material. The stability is assessed by means of measurement of available oxygen in the percarbonate containing formulation, following storage under controlled conditions of humidity and/or temperature. For example, at 28° C. in sealed bottles, or at 28° C. in standard detergent packs at a relative humidity of 70%. The available oxygen so measured is then quoted relative to the available oxygen in the same formulation prior to storage.

Optional Components

As indicated previously, the detergent powder of the invention can contain any of the ingredients conventionally present in compositions intended for the washing of fabrics. Examples of such components include inorganic and organic detergency builders, other inorganic salts, sodium silicate, bleaches, fluorescers, polymers, lather control agents, enzymes and perfumes.

If desired, the powder of the invention may contain one or more soaps of fatty acids, in addition to the non-soap anionic surfactant mentioned above.

Other materials that may be present in the powder of the invention include fluorescers, anti-redeposition agents, inorganic salts such as sodium sulphate, enzymes, lather control agents, bleaches, bleach activators, and bleach stabilisers. These may be included in the spray-dried base powder or postdosed according to their known suitability for undergoing spray-drying processes and their compatibility with other slurry ingredients.

The invention is further illustrated by the following non-limiting Examples, in which parts and percentages are by weight unless otherwise stated.

EXAMPLE 1

A zero-phosphate detergent base powder containing zeolite was prepared, by slurry-making and spray-drying, to obtain the following nominal composition:

| | Parts | wt % |
|---|---|---|
| Sodium linear alkylbenzene sulphonate (1) | 9.0 | 16.8 |
| Nonionic surfactant (2) | 4.0 | 7.5 |
| Zeolite (anhydrous) | 24.0 | 44.8 |
| Acrylic/maleic copolymer (3) | 4.0 | 7.5 |
| Sodium carbonate | 2.0 | 3.7 |
| Minor ingredients | 1.5 | 2.9 |
| Moisture | 9.0 | 16.8 |
| Total: | 53.5 | 100.0 |

(1) Prepared by neutralization of MANRO NA (Trade mark), a narrow cut straight chain dodecyl benzene sulphonate ex Manro Products
(2) A mixture of 3:1 (w/w) of Synperonic A3 and A7 ethoxylated fatty alcohols ex ICI, containing 3 and 7 EO groups respectively.
(3) Sokalan (Trade Mark) CP5 ex BASF Subsequently, 1.25 g of a commercially available sodium percarbonate (Oxyper ex Interox), having a weight mean average particle size of 437 microns and a coefficient of variation (CV) of 0.491 was added to 8.75 g of the spray-dried base powder. The resulting powder was thoroughly mixed, and then stored in a sealed bottle at a temperature of 28° C. for a period of 6 weeks.

EXAMPLE 2

Example 1 was repeated, except that sodium percarbonate was used having a weight mean average particle size of 268 microns with a CV of 0.089. The percarbonate was prepared by fractionating Interox Oxyper sodium percarbonate.

EXAMPLE 3

Example 1 was repeated, except that sodium percarbonate was used having a weight mean average particle size of 428 microns with a CV of 0.046. The percarbonate was prepared by fractionating Interox Oxyper sodium percarbonate.

EXAMPLE 4

Example 1 was repeated, except that sodium percarbonate was used having a weight mean average particle size of 605 microns with a CV of 0.095. The percarbonate was prepared by fractionating Interox Oxyper sodium percarbonate.

EXAMPLE 5

Example 1 was repeated, except that sodium percarbonate was used having a weight mean average particle size of 855 microns with a CV of 0.16. The percarbonate was prepared by fractionating Interox Oxyper sodium percarbonate.

EXAMPLE 6

The base powder/sodium percarbonate mixtures of examples 1-5 were each individually analyzed for available oxygen remaining following the 6 week storage period. The results are given in Table 1. They are quoted as the percentage decomposition compared to the available oxygen in the initial samples prior to storage. The results clearly show the improved stability for materials of this invention (examples 3-5, having a morphology index of <0.06)

TABLE 1

| Example | Morphology Index | % Decomposition |
|---|---|---|
| 1 | 0.0653 | 61 |
| 2 | 0.193 | 85 |
| 3 | 0.0483 | 42 |
| 4 | 0.0206 | 39 |
| 5 | 0.013 | 36.5 |

EXAMPLE 7

A sample of sodium percarbonate having a weight mean average particle size of 605 microns with a CV of 0.095 was prepared by fractionation of a commercially available sample of sodium percarbonate (ex Degussa). 1.25 g of this material was thoroughly mixed with 8.75 g of the base powder of Example 1. This mixture was then stored in a sealed bottle at a temperature of 28° C. for a period of 6 weeks.

EXAMPLE 8

The mixed base powder/sodium percarbonate sample from Example 7 was analyzed for available oxygen following the 6 week storage period in exactly the same manner as described in Example 6. The result of this analysis is given in Table 2 in comparison to an equivalent sample based on percarbonate from a second commercial supplier.

TABLE 2

| Example | Morphology Index | % Decomposition |
|---|---|---|
| 1 | 0.0653 | 61 |
| 7 | 0.0206 | 45 |
| 4 | 0.0206 | 39 |

It follows from the results given above, that the improved storage stability through control of percarbonate morphology according to this invention is not dependant on the source of the percarbonate used.

What is claimed is:

1. A particulate bleaching detergent composition comprising an aluminosilicate built base powder and alkalimetal percarbonate particles having a Morphology Index of less than 0.06, said Morphology Index defined as:

$$MI=0.0448*CV+3.61*10^6/d^3$$

wherein d is weight mean average particle size;

$CV=\sigma/d$;

$\sigma^2=\Sigma(d_i-d)^2*w_i/100$;

$d=\Sigma d_i*w_i/100$;

$d_i$ is an average particle size of the i'th size fraction of a complete distribution of particles; and $w_i$ is a weight percentage of said fraction.

2. A composition according to claim 1 wherein the morphology index of the percarbonate particles is less than 0.04.

3. A composition according to claim 1 wherein the morphology index of the percarbonate particles is less than 0.03.

4. A composition according to claim 1 wherein the percarbonate is an uncoated material.

5. A composition according to claim 1 wherein the base powder contains more than 20 ppm iron.

6. A composition according to claim 1 wherein the base powder contains more than 5 ppm copper.

7. A composition according to claim 1 wherein the alkalimetal percarbonate is sodium percarbonate.

8. A composition according to claim 1 which is substantially free from inorganic phosphate.

9. A composition according to claim 1 containing least 5% by weight of one or more anionic surfactants.

10. A composition according to claim 1 comprising from 20 to 80% by weight of crystalline or amorphous aluminosilicate detergency builder.

11. A composition according to claim 1 containing no more than 10% by weight of alkali metal silicate.

12. A composition according to claim 1 having a bulk density of at least 450 g/liter.

13. A composition according to claim 1 having a bulk density of at least 600 g/liter.

14. Alkalimetal percarbonate particles having a Morphology Index of less than 0.06, said Morphology Index defined as:

$$MI = 0.0448 * CV + 3.61 * 10^6 / d^3$$

wherein d is weight mean average particle size;

$CV = \sigma / d$;

$\sigma^2 = \Sigma (d_i - d)^2 * w_i / 100$;

$d = \Sigma d_i * w_i / 100$;

$d_i$ is an average particle size of the i'th size fraction of a complete distribution of particles; and $w_i$ is a weight percentage of said fraction.

15. A composition according to claim 1 wherein the aluminosilicate is present in an amount from 10 to 80% by weight.

16. A composition according to claim 15 wherein the alkalimetal percarbonate particles are present in an amount from 5 to 25% by weight.

* * * * *